US008915568B2

(12) United States Patent
Gracia Verdugo et al.

(10) Patent No.: US 8,915,568 B2
(45) Date of Patent: Dec. 23, 2014

(54) SYSTEM AND METHOD FOR ADAPTIVE PRINTHEAD TEMPERATURE CONTROL

(71) Applicant: Hewlett-Packard Development Company, L.P., Houston, TX (US)

(72) Inventors: Antonio Gracia Verdugo, Sant Cugat del Valles (ES); Gonzalo Gaston Llado, Sant Cugat del Valles (ES); Juan Uroz Soria, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 66 days.

(21) Appl. No.: 13/872,661

(22) Filed: Apr. 29, 2013

(65) Prior Publication Data

US 2014/0320563 A1 Oct. 30, 2014

(51) Int. Cl.
*B41J 29/38* (2006.01)
*B41J 2/045* (2006.01)

(52) U.S. Cl.
CPC ..... *B41J 2/04563* (2013.01)
USPC ..... 347/17

(58) Field of Classification Search
USPC ..... 347/9, 14, 16, 17
See application file for complete search history.

(56) References Cited

U.S. PATENT DOCUMENTS

| | | | | |
|---|---|---|---|---|
| 4,910,528 | A | 3/1990 | Firl et al. | |
| 5,475,405 | A | 12/1995 | Widder et al. | |
| 6,382,773 | B1 | 5/2002 | Chang et al. | |
| 6,435,668 | B1 | 8/2002 | Barbour et al. | |
| 6,601,941 | B1 | 8/2003 | Jones et al. | |
| 6,871,929 | B2 * | 3/2005 | Crivelli et al. | 347/17 |
| 7,101,010 | B2 | 9/2006 | Holstun et al. | |
| 7,654,628 | B2 * | 2/2010 | Silverbrook | 347/17 |
| 2003/0142159 | A1 | 7/2003 | Askeland et al. | |
| 2007/0153045 | A1 * | 7/2007 | Barkley et al. | 347/17 |
| 2010/0149237 | A1 * | 6/2010 | Takabayashi et al. | 347/9 |
| 2013/0050327 | A1 * | 2/2013 | Snyder et al. | 347/16 |

OTHER PUBLICATIONS

Wassink, M.B.G. Inkjet Printhead Performance Enhancement by Feedforward Input Design Based on Two-port Modeling (Research Paper), Feb. 12, 2007.

* cited by examiner

*Primary Examiner* — Kristal Feggins
(74) *Attorney, Agent, or Firm* — Boehmert & Boehmert; Dennis Kretschmann

(57) ABSTRACT

A printing system with adaptive printhead temperature control, comprises a least one printhead for inkjet printing; heating means to heat said printhead or ink in said printhead to a predetermined temperature range; and control means to analyze content information of a print job to be printed, wherein said control means sets said predetermined temperature range and sets a heating power of said heating means at a given position of said printhead in accordance with content information relating to an entire print page of said print job, or a plurality of print pages of said print job.

20 Claims, 6 Drawing Sheets

SYSTEM AND METHOD FOR ADAPTIVE PRINTHEAD TEMPERATURE CONTROL

BACKGROUND

In conventional scanning inkjet printers, inkjet printheads typically move across print media depositing ink droplets one swath at a time to form a desired image on a printing medium. A printhead is sometimes in the art also referred to as a pen. In a color printer, several such printheads or pens may be positioned adjacent to one another, each one corresponding to one basic color, and may together travel across the printing medium. In a conventional inkjet printer, each printhead comprises a series of ink-ejecting nozzles and a corresponding plurality of ejection chambers associated with the nozzles. Ink is supplied to the ejection chamber from an ink reservoir, such as an ink cartridge. In thermal inkjet printheads, a firing resistor is located adjacent to the ejection chamber, and may be selectively energized to heat ink in the ejection chamber to a boiling point, which forces an ink droplet to be ejected through the associated nozzle. Piezoelectric printheads use a piezoelectric material in an ink-filled chamber behind each nozzle instead of a heating element. When a voltage is applied, the piezoelectric material changes shape, which generates a pressure pulse in the fluid forcing a droplet of ink from the nozzle.

During the printing, the printhead usually heats up, both due to the operation of the firing resistors (in thermal printers) as well as due to the heat generated by the mechanical movement of the printer and power dissipation from the electronics circuits. When the temperature of the printhead varies, so does the ink viscosity.

DETAILED DESCRIPTION OF EMBODIMENTS

Changes in ink viscosity during printing affects the amount of ink ejected and the size of the resulting droplet, a phenomenon which is studied by referring to the resulting "drop weight" of the ejected droplet.

Figure 1:
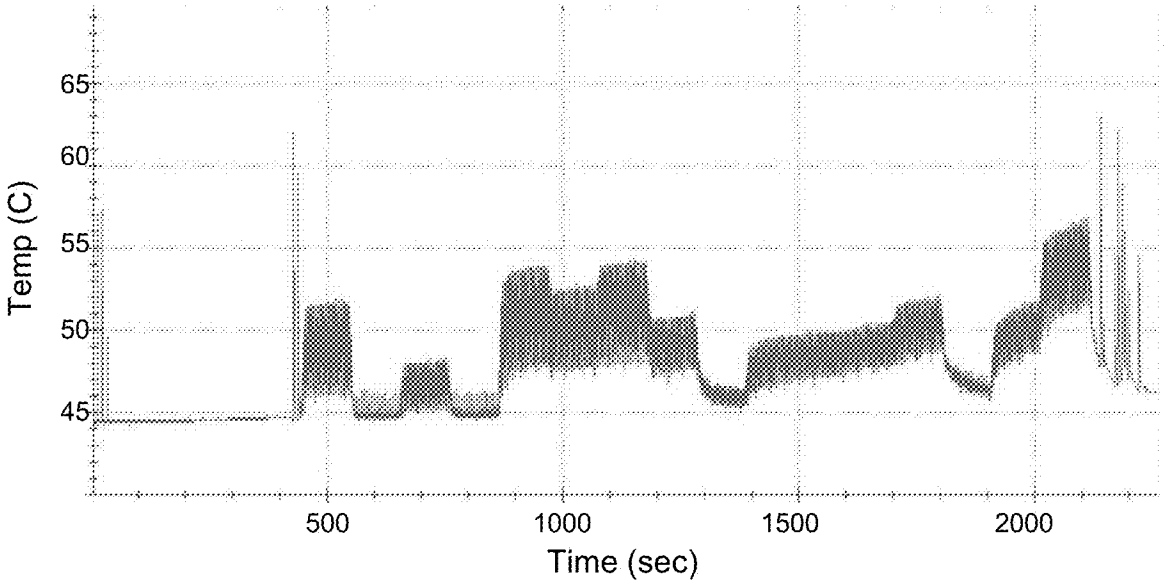
FIG. 1 is a diagram which shows the variations of the printhead temperature over time while a exemplary print job with multiple colors is printed.

FIG. 1 is a diagram that shows the variations in temperature of an inkjet printhead over time in the course of a typical print job without temperature control. Sections with higher temperature correspond to portions of the print job where the pixel density of the color that the given printhead prints is high, and hence the printhead heats up. Sections with lower temperature correspond to portions with a lower density of the respective color, or portions of the print job where the total pixel density is low, and the printhead cools down. As can be taken from FIG. 1, the temperature of the printhead may vary by as much as 15° C. in a typical print job. These variations and the corresponding change in the ink viscosity may lead to unwanted color differences, in particular when modern inks are used whose viscosity varies strongly with temperature, such as pigmented, water-based inks using aqueous-dispersed polymer ("Latex") technology.

In order to address these problems, some printers are provided with trickle warming systems that may pre-warm or pre-heat the ink prior to ejection so as to keep the printhead at a constant predetermined working temperature across consecutive swaths. The trickle warming system may employ the firing resistors to preheat the ink to the pre-set operating tempera-tore/set point temperature. Alternatively, a separate heater array system, such as a resistive heater, may be employed. The temperature of the printhead may be monitored by means of a temperature sensor, such as a thermal sense resistor (TSR).

Figure 2:
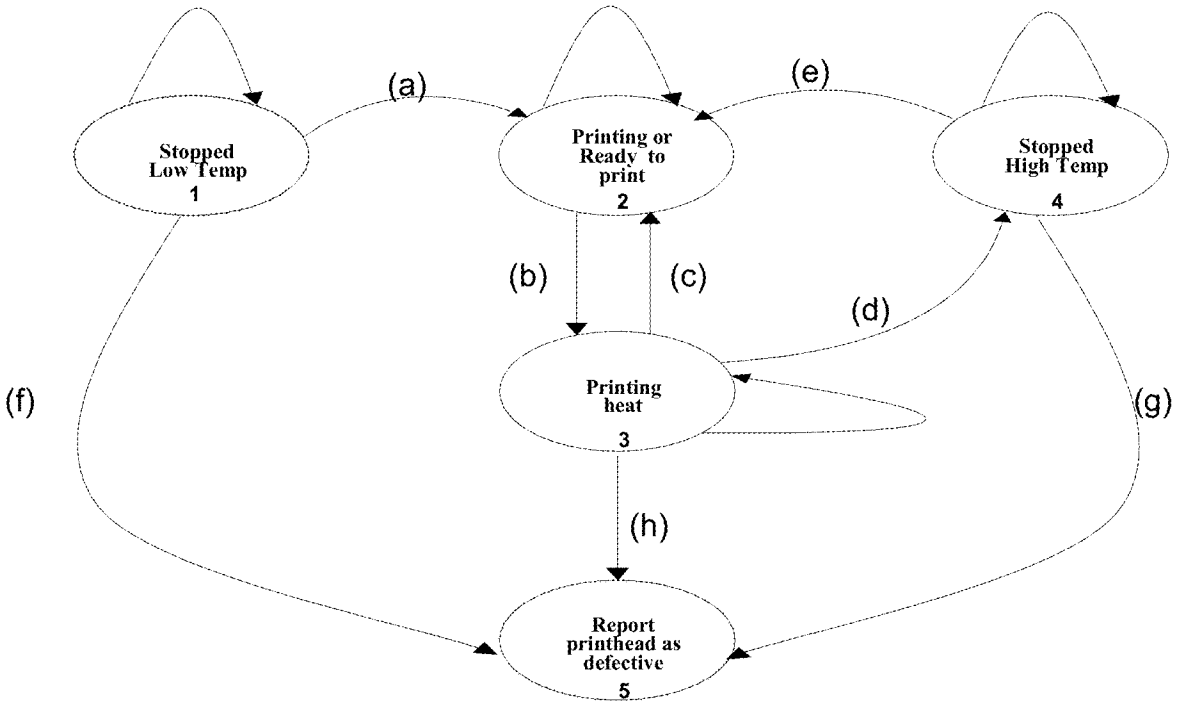
FIG. 2 is a state diagram of a trickle warming system.

FIG. 2 is a schematic flow diagram that illustrates a trickle warming algorithm for temperature control of a printhead. Circles denote operating states in FIG. 1, whereas the arrows labeled (a) to (h) denote transitions between different states. Self-referring arrows denote operating circles within a given state. In the rest state designated by circle 1, the printer is stopped and the printhead has cooled down. Before printing begins, the trickle warming system heats up the printhead to above a minimum printing temperature (arrow a). Once the temperature has reached a predetermined temperature interval above the minimum temperature, the printhead is ready for printing (circle 2).

Printing will generate heat, which will heat up the printhead if the pixel density of the respective color is sufficiently high (arrow b). Heat can be generated by the operation of firing resistors (in thermal printers) as well as due to the heat generated by the mechanical movement of the printer and power dissipation from the electronics circuits, for example. If, on the other hand, the printer prints at low speed, or the pixel density of the respective color is low, or the printhead reaches the end of a swath, the printhead will cool down due to thermal convection (arrow c). In the printing phases where the temperature falls below the predefined temperature interval, the trickle warming system is activated to heat up the printhead until the temperature falls within the target interval. During printing operation, the printhead hence moves back and forth between states designated by circles 2 and 3 in FIG. 2. The temperature of the printhead is monitored continuously, and printing is continued as long as the temperature of the printhead is within the predefined temperature interval around the temperature set point.

If the temperature of the printhead exceeds the predetermined temperature interval, printing is slowed down or, in the worst case, even needs to be interrupted (arrow d). In the state denoted by circle 4, printing has paused and the printhead is allowed to cool down until the predetermined set point temperature is reached and the system returns to circle 2 via arrow (e).

If the printhead fails to heat up from the rest state denoted by circle 1 (arrow f), or the printhead fails to cool down to within the predetermined temperature interval within a predefined time interval (arrows g or h), the printhead is reported as defective (circle 5).

The system described above with reference to FIG. 2 has been found to perform well when temperature variations across a sufficiently wide temperature range are acceptable, such as 5° C. around the temperature set point. If temperature variations shall be restricted further, depending on the print job the system may repeatedly enter a cool-off state 4, or the print speed may need to be reduced frequently. This slows down the printing.

Improved printing results and color consistency can be achieved with a printing system employing an adaptive printhead temperature control, wherein the system comprises at least one printhead for inkjet printing, heating means to heat said printhead or ink within said printhead to a predetermined temperature range, and control means to analyze content information of a print job to be printed, wherein said control means sets said predetermined temperature range and sets the heating power of said heating means at a given position of said printhead in accordance with content information relating to an entire print page of said print job, or a plurality of print pages of said print job.

Setting the predetermined temperature range in accordance with content information relating to an entire print page of the print job, or even a plurality of print pages of said print job, allows to maintain color consistency across the entire print job without compromises in printing speed. In accordance with the content information of the entire print page, or even the entire print job, the heating power of said heating means for heating up said printhead or ink within said printhead may be adjusted at a given position of said printhead while printing said print job so as to ensure that the printhead or ink always maintains a temperature within the predetermined temperature range.

The predetermined temperature range may be a temperature interval of 10° C. or less, for example 5° C. or less, or even 3° C. or less.

The print job may comprise printing one page on a printing medium or printing a plurality of pages on a printing medium. Color consistency is ensured across the one page or plurality of pages.

The temperature control according to the present disclosure is adaptive in the sense that the system does not set a fixed temperature range for the printhead or ink within said printhead, or a fixed set point temperature, but rather allows the temperature range and set point temperature, i.e. the desired working temperature, to vary in accordance with the content information relating to an entire print page of said print job, or a plurality of pages of said print job.

Said control means can analyze said content information of said print job prior to printing said print job.

In an example, said control means sets said heating power in accordance with an estimated usage of ink and/or pixel density count. The usage of ink or the pixel density count may pro-vide a reliable estimate of the expected heating up of the printhead while printing.

The printing system may comprise sensor means to monitor a temperature of said printhead or ink within said printhead. This allows to continuously check whether the temperature of the printhead or ink is within the expected and predetermined temperature range.

In an example, said control means, based on said analysis of said content information, generates a temperature map corresponding to said print job. Said temperature map can associate portions of said print job with an estimated printhead or ink temperature at said respective portions, or with a required degree of heat-up through said heating means at said respective portions.

Said portions may be parts of the print job corresponding to a certain area on the printing medium, or corresponding to a plurality of adjacent pixels.

The temperature map captures the expected degree of heat up of the printhead based on the content information of said print job, and may be computed based on reference tables and the estimated usage of ink and/or a pixel density count.

Said control means may set a heating power of said heating means in accordance with said temperature map.

In an example, said temperature map is generated prior to printing said print job.

In another example, said control means updates said temperature map while printing said print job.

Said temperature map may be updated based on a temperature measurement of said printhead or ink at a current position of said printhead and/or based on an estimated temperature of said printhead or ink within said printhead at subsequent portions of said print job.

By continuously monitoring the temperature of said printhead or ink within said printhead and updating the temperature map accordingly, the accuracy of the temperature control may be enhanced.

Said control means may set said heating power of said heating means so as to ensure that a temperature of said printhead or ink within said printhead is within said predetermined temperature range for a plurality of portions of said print job having one and the same color or similar colors. This may ensure color consistency across the print job.

Said portions of said print job having one and the same or similar colors may be separate portions on one and the same print page, or portions on different pages of said print job.

Said heating means, in a thermal printhead, may comprise firing resistors associated with the nozzles of said printhead. In another example, it may comprise a separate heating array/unit which may be used in combination with a thermal or piezoelectric printhead, for example. For example, it is possible to integrate heating devices, such as tiny resistors, inside the printhead electronics also as part of a piezoelectric printhead and controls the resistors as described herein. It also is possible to use an external heated module, e.g. a metal plate, in close contact with a printhead to perform this function. For instance, an aluminum protection cover protecting a silicon nozzle plate could be used for this purpose.

The above description has referred to a single printhead for inkjet printing. However, printers often have more than one printhead, such as for printing different basic colors. The printing system may then adaptively control the temperature of each of these printheads individually, depending on the content information of an entire print page of the print job, or a plurality of pages of said print job.

Hence, the printing system may comprise a plurality of printheads and a plurality of heating means to heat said printheads to predetermined temperature ranges, wherein said control means sets said predetermined temperature ranges and sets a heating power of said heating means individually for each printhead.

Each of the printheads may be configured and controlled as described above for the single printhead.

The present disclosure further relates to a method for adaptive temperature control of a printhead for inkjet printing, wherein said printhead is provided with heating means, and said method comprises: analyzing content information of a print job to be printed and setting a predetermined temperature range for said printhead or ink within said printhead, and setting the heating power of said heating means at a given position of said printhead in accordance with content information relating to an entire print page of said print job, or a plurality of print pages of said print job.

The method may comprise analyzing said content information of said print job prior to printing said print job.

In an example, the method comprises setting said heating power in accordance with an estimated usage of inks and/or a pixel density count.

The method may comprise generating a temperature map corresponding to said print job. Said temperature map can associate portions of said print job with an estimated printhead or ink temperature at said portion, or with a required degree of heat-up.

Said heating power of said heating means may be set in accordance with said temperature map.

Said temperature map may be updated while printing said print job.

In an example, said heating power of said heating means may be set so as to ensure that a temperature of said printhead or ink within said printhead is within said predetermined temperature range for a plurality of portions of said print job having one and the same color or similar colors.

As described above, said portions of said print job having one and the same or similar colors may be separated portions on one and the same print page, or may be portions on different pages of the print job.

The present disclosure further relates to a computer-readable medium storing computer-readable instructions, wherein said computer-readable instructions, when run on a computer system connected to a control means of a printing system, cause said control means to implement a method with some or all of the functions described above.

The present disclosure can be employed with ease in any printing system for inkjet printing, such as in the printing system described in the background section above. Such a printing system may comprise a plurality of printheads mounted side-by-side on a carriage that moves across print media, such as paper or textiles. Each of the printheads may correspond to a predetermined basic color, such as black, cyan, magenta or yellow, and other colors may be printed by superposing basic colors. Each of the printheads may be connected to its own ink reservoir, such as a cartridge integrally connected to the printhead, or an external ink tank connected to the printhead via a flexible conduit. Each of the printheads may comprise a series of ink-ejecting nozzles, wherein firing resistors or piezoelectric elements are located adjacent to an ejection chamber associated with each nozzle. A trickle warming system may pre-warm or pre-heat the ink prior to ejection, either by means of the firing resistors or by means of a separate heater array system associated with the nozzles. In one embodiment, the system can control just a small amount of ink closest to the drop ejection site in the printhead. This allows adjusting temperatures in a very short time lapse. For example, in one embodiment, it may be sufficient to affect mainly the ink in an ink channel that feeds the nozzles. This ink channel is part of the so-called "standpipe" of the print head, which is the volume (of about 1 or 2 cubic centimeters) of the printhead in between the last filter stage, and the ejection nozzles. In other embodiment, smaller or larger volumes of ink can be heated, and heat control can be performed based on an actual ink temperature or based on the printhead temperature, at a predetermined part thereof. For the sake of convenience, the following description makes reference to the printhead temperature, without limiting the present disclosure.

A printer controller may run a program to control the trickle warming, as will now be described. The method for setting the heating power of the trickle warming system is generally similar to the algorithm described with reference to FIG. 2 above, but differs from it in that the temperature set point is not fixed at circles 2 and 3, but is rather variable and is set in accordance with content information relating to an entire print page of said print job, or a plurality of print pages of said print job.

Figure 3A:
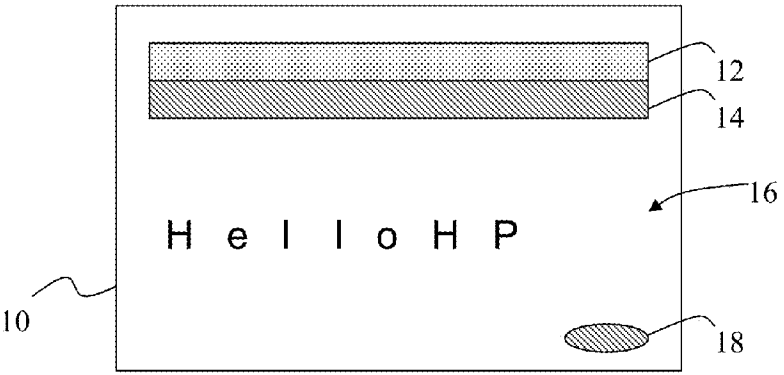
FIG. 3*a* is an example of a print job for illustrating the adaptive trickle warming according to the present disclosure.
Figure 3B:
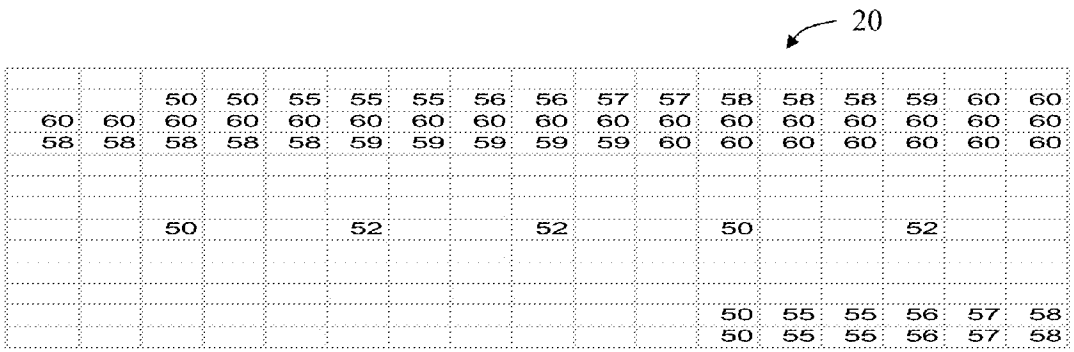
FIG. 3*b* is a temperature map according to an example of the present disclosure pertaining to the print job of FIG. 3*a;*

Reference is made to FIGS. 3*a* and 3*b* to illustrate how the heating power may be set in accordance with content information relating to an entire print page. FIG. 3*a* shows an exemplary print page 10 to be printed on a printing medium, such as a letter-sized sheet of paper. The print page 10 comprises a first color block 12 at a top portion of the print page, such as a block of red color, below which a second color block 14, such as a cyan color block is printed. After a blank gap, a text block 16 in cyan color is printed, followed by another gap and a small area fill 18 in the lower right corner of the print page 10.

The ink usage per unit area of the print page 10 may be estimated from the density count. This can be done by counting the number of times that each HiFipe level occurs in each density counting region. The height of this region may be the same as the height of the swath being processed. The region width may be variable, and may be set to 64, 128, 256 or 512 pixels. The current value may be stored for each densitometer region. Counting may be performed for both input and output planes.

Based on the pixel density of the image to be printed and the estimated ink usage, the printer controller computes a temperature map 20 pertaining to the print page 10 for each of the printheads. FIG. 3*b* shows the temperature map 20 for a cyan printhead. The boxes in the temperature map 20 correspond to positions on the print page, and the entries correspond to the expected temperature or heat-up of the cyan printhead (in degrees Celsius) at the respective positions due to operational heat-up without adaptive temperature control. Boxes at positions without print content for the respective printhead are left blank.

The temperature map 20 hence shows the temperatures the printhead would reach at the respective positions of the print page 10 if no temperature corrections were made by adaptive trickle warming. This directly translates into the corrections or additional heat-up are required to ensure a stable temperature. Each of the lines in the temperature map 20 may correspond to a single swath of the printhead. However, a coarser subdivision may also be used, depending on the applications. In the example shown in FIG. 3*b*, the temperature map 20 divides the width of the print page 10 into seventeen equally-spaced portions. However, this is a mere example and finer or coarser subdivisions along the width direction may be used, depending on the applications and the desired degree of accuracy.

With reference to the specific example and the temperature map 20, it can be seen that the temperature of the cyan printhead gradually heats up from 50° C. to 60° C. as the first color block 12 is printed, and this temperature range is maintained while the second color block 14 is printed. After printing the second color block 14, there is a large gap, and hence the cyan printhead will cool down to about 50° C. prior to printing the words "Hello HP". The cyan printhead will heat up a little while printing the text 16. However, the letters of the text 16 have sufficient spacing between them to allow the cyan printhead to cool down prior to printing another letter, and hence the temperature remains relatively low.

After printing the text 16, there is again a gap that allows the cyan printhead to cool down to 50° C. before printing the small area fill 18. While printing the small area fill 18, the printhead will again heat up, but only to 58° C. due to the smallness of this portion.

The temperature map 20 may be compiled by relying on look-up tables that associate the amount of ink per unit area with a corresponding degree of heat-up or temperature of the printhead. Some corrections may also be included depending on ambient temperature, which may influence the printer performance and behavior.

Once the temperature map 20 for the print page 10 has been derived, the variable-adaptive trickle warming anticipates the temperature differences and sets the heating power of the trickle warming system so as to compensate for the differences in the temperature map 20. For instance, in those portions of the print page 10 where the estimated printhead temperature is low, the heating power would be increased. In those portions of the print page 10 where the expected temperature is high, the heating power may be reduced, or the heating means may even be deactivated in these portions. The heating power may be selected such that the temperature differences in the temperature map 20 are compensated, and the temperature of the printhead is almost constant, or within a very narrow predetermined temperature range (such as 3° C. or less) across the entire print page 10.

Corresponding temperature maps may be generated for all the printheads of the printing system, and the heating power of those printheads may be adjusted so that a constant temperature is maintained within those printheads as well.

Since the temperature of the printhead is constant across the entire print page 10, color consistency is ensured across the entire print page 10.

Figure 4:
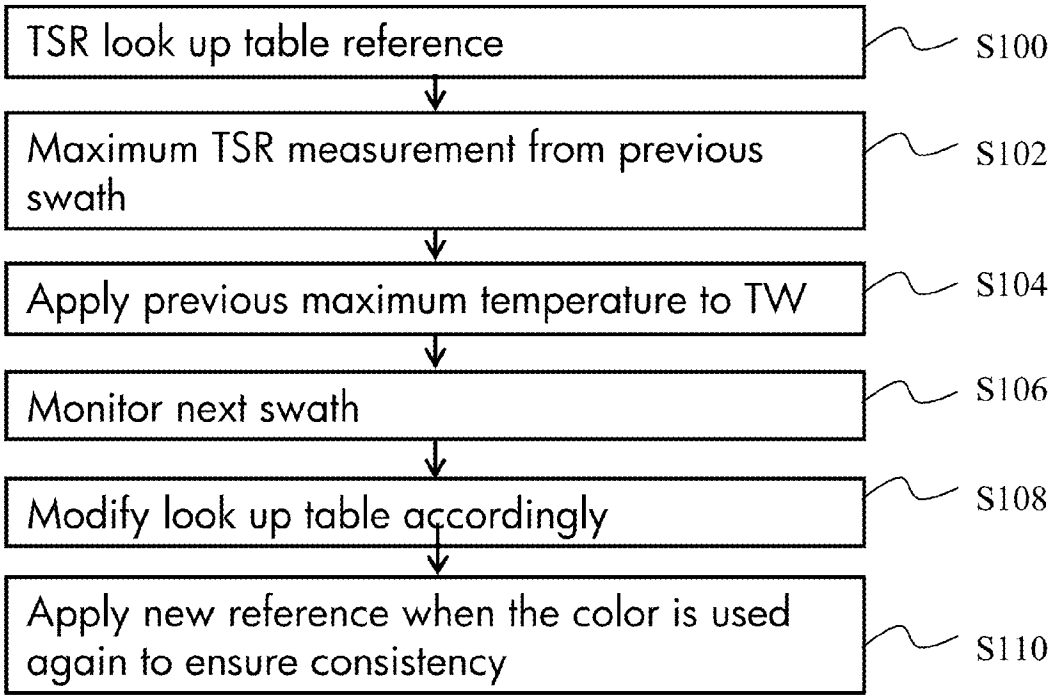
FIG. 4 is a flow diagram illustrating an algorithm for adaptive trickle warming according to an example of the present disclosure.

In an example, the printhead is provided with a temperature sensor, such as a thermal sense resistor (TSR), which allows the control means to constantly monitor the temperature of the printhead and to adapt the temperature map 20 in accordance with the measured temperature of the printhead. The heating power of the heating means may then be adjusted accordingly based on these measurement values. The look-up tables on which the temperature maps 20 are based may also be updated based on the measurement results of the thermal sense resistor (TSR). A corresponding flow diagram is shown in FIG. 4.

In block S100, a TSR look-up table reference is consulted to determine the expected temperature from the computed usage of ink at a certain position of the print page 10. In block 5102, the maximum TSR measurement from the previous swath is derived, and it is applied based on the look-up table reference to the trickle warming algorithm for the current swath (block S104). The subsequent swath is monitored in block S106, and is compared with the estimate derived from the look-up table. If the difference between the actual temperature and the expected temperature is above a predetermined threshold, the look-up table may be modified accordingly in block S108. The new look-up table may be applied when the same color is used again, so as to ensure color consistency across the print job (block S110).

With reference to FIGS. 3*a* and 3*b*, the present disclosure has been described for the example of ensuring color consistency within the same print page 10. However, the present disclosure is particularly useful also in situations in which color consistency between different print pages of a print job has to be ensured, such as when large printouts are produced from separate tiles.

Figure 5:
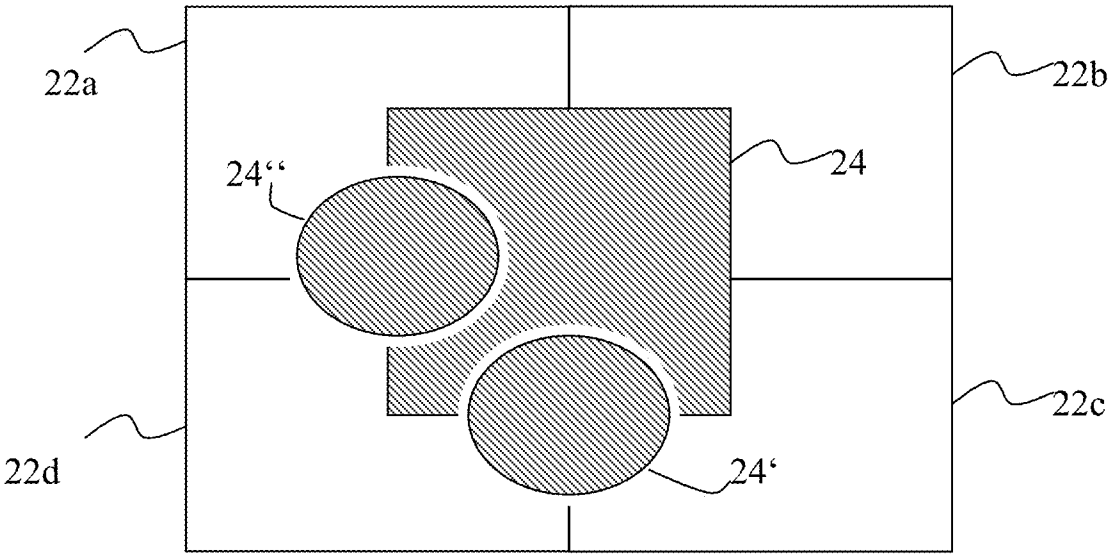
FIG. 5 illustrates the adaptive trickle warming according to the present disclosure for an example of a print job with several tiles.

FIG. 5 shows the example of a print job divided into four pages or tiles 22*a* to 22*d*. The variable adaptive trickle warming proceeds in a similar way as described with reference to the previous embodiment of FIG. 3. However, in this example, the control means analyzes the content information of the entire print job comprising the four tiles 22*a* to 22*d* so as to ensure the color consistency across all the tiles 22*a* to 22*d*. Since it is known, at any time, what the printhead is going to print, the trickle warming may vary and adapt its performance to the behavior in the first tile 22*a* to produce consistent colors in the rest of the tiles 22*b* to 22*d*. This ensures color consistency across all the tiles of the print job, and in particular ensures that the colors of area fills 24, 24', 24" that extend across several tiles perfectly match.

As illustrated with reference to the examples of FIGS. 3 to 5, by knowing the temperature reached in the nozzle plate of the printheads, changes can be made to the trickle warming parameters of the printheads so as to adapt to and compensate the temperature differences and to ensure color consistency across the entire print job. Dynamic temperature maps or look-up tables may be employed so as to match the ink quantity to the printer temperature and to adapt the trickle warming settings in accordance with temperature and performance measurements.

Figure 6:
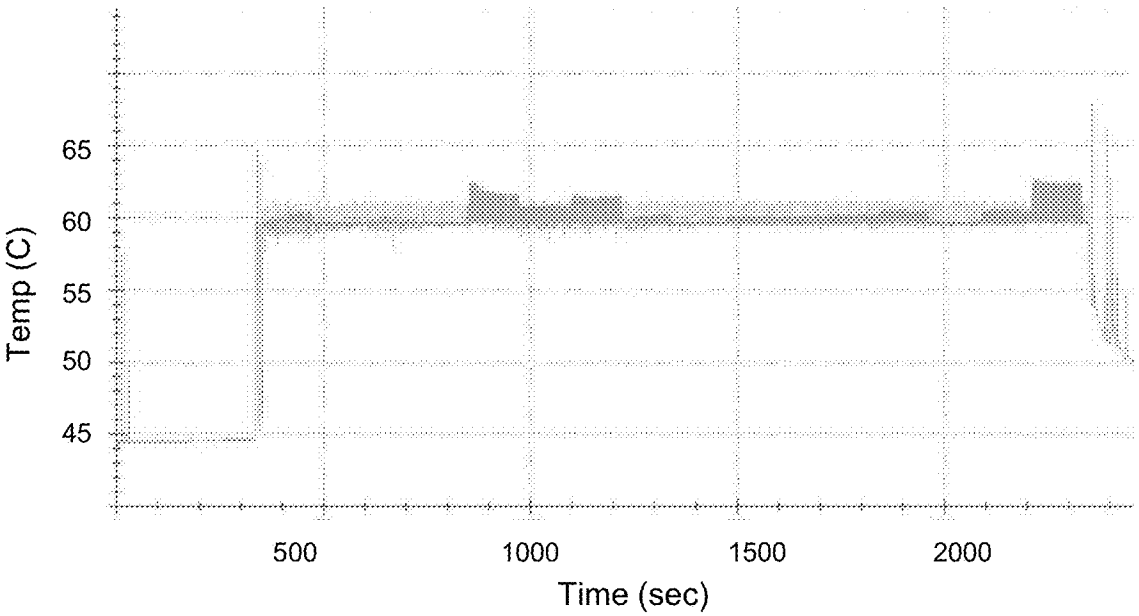
FIG. 6 is a diagram illustrating the temperature variations for a printhead employing the adaptive trickle warming according to an example of the present disclosure.

FIG. 6 is a diagram that shows variations of the temperature of a cyan printhead for the exemplary print job of FIG. 1 when employing the variable-adaptive trickle warming according to the present disclosure. As can be taken from FIG. 6, the temperature of the printhead can be maintained within ±2° C. around a predetermined set point of 60° C., which is a significant improvement over the conventional printing system in FIG. 1.

The examples and Figures merely serve to illustrate the invention, but should not be under-stood to imply any limitation. The scope of the invention is defined only by the appended claims.

REFERENCE SIGNS

10 print page
12 first color block
14 second color block
16 text
18 small area fill
20 temperature map
22*a*-22*d* tiles
24, 24', 24" area fills

The invention claimed is:

1. A printing system with adaptive printhead temperature control, comprising:

a least one printhead for inkjet printing;

heating means to heat said printhead or ink in said printhead to a predetermined temperature range; and control means to analyze content information of a print job to be printed, wherein said control means sets said predetermined temperature range and sets a heating power of said heating means at a given position of said printhead in accordance with content information relating to an entire print page of said print job, or a plurality of print pages of said print job.

2. The printing system according to claim 1, wherein said control means analyzes said content information of said print job prior to printing said print job.

3. The printing system according to claim 1, wherein said control means sets said heating power in accordance with an estimated usage of ink and/or a pixel density count.

4. The printing system according to claim 1, further comprising sensor means to monitor a temperature of said printhead or said ink in said printhead.

5. The printing system according to claim 1, wherein said control means, based on said analysis of said content information, generates a temperature map corresponding to said print job, wherein said temperature map associates portions of said print job with an estimated printhead ink temperature at said respective portions or a required heat-up at said respective portions.

6. The printing system according to claim 5, wherein said control means sets a heating power of said heating means in accordance with said temperature map.

7. The printing system according to claim 5, wherein said control means updates said temperature map while printing said print job.

8. The printing system according to claim 7, wherein said control means updates said temperature map based on a temperature measurement of said printhead or said ink in said printhead at a current position of said printhead and/or based on an estimated temperature of said printhead or said ink in said printhead at subsequent portions of said print job.

9. The printing system according to claim 1, wherein said control means sets said heating power of said heating means so to ensure that a temperature of said printhead or said ink in said printhead is within said predetermined temperature range for a plurality of portions of said print job having one and the same color.

10. The printing system according to claim 9, wherein said portions of said print job having one and the same color are separated portions on one and the same print page, or are portions on different pages of said print job.

11. The printing system according to claim 1, comprising a plurality of printheads and a plurality of heating means to heat said printheads or said ink in said printhead to predetermined temperature ranges, wherein said control means sets said predetermined temperature ranges and sets a heating power of said heating means individually for each printhead.

12. The printing system according to claim 1, comprising a thermal printhead or a piezoelectric printhead wherein said heating means is integrated inside printhead electronics or provided in an external heated module in thermal contact with the print head.

13. A computer readable medium storing computer-readable instructions, wherein said computer-readable instructions, when run on a computer system connected to a control means of a printing system, cause said control means to implement a method according to claim 12.

14. A method for adaptive temperature control of a printhead for inkjet printing, wherein said printhead is provided with heating means, and said method comprises:

analyzing content information of a print job to be printed; and setting a predetermined temperature range for said printhead or for ink in said printhead, and setting a heating power of said heating means at a given position of said printhead in accordance with content information relating to an entire print page of said print job, or a plurality of print pages of said print job.

15. The method according to claim 14, comprising analyzing said content information of said print job prior to printing said print job.

16. The method according to claim 14, comprising setting said heating power in accordance with an estimated usage of ink and/or a pixel density count.

17. The method according to claim 14, comprising: generating a temperature map corresponding to said print job, wherein said temperature map associates portions of said print job with an estimated printhead or ink temperature at said portion; and setting a heating power of said heating means in accordance with said temperature map.

18. The method according to claim 17, comprising updating said temperature map while printing said print job.

19. The method according to claim 14, comprising setting said heating power of said heating means so to ensure that a temperature of said printhead or said ink in said printhead is within said predetermined temperature range for a plurality of portions of said print job having one and the same color.

20. The method according to claim 14, wherein said portions of said print job having one and the same color are separated portions on one and the same print page, or are portions on different pages of said print job.

* * * * *